US010907312B2

(12) United States Patent
White

(10) Patent No.: US 10,907,312 B2
(45) Date of Patent: Feb. 2, 2021

(54) ROAD FORM WORK

(71) Applicant: FAST-FORM SYSTEMS LTD, Grimbsy (GB)

(72) Inventor: Tony White, Cleethorpes (GB)

(73) Assignee: Fast-Form Systems Ltd, Grimbsy (GB)

( * ) Notice: Subject to any disclaimer, the term of this patent is extended or adjusted under 35 U.S.C. 154(b) by 36 days.

(21) Appl. No.: 16/334,824

(22) PCT Filed: Jul. 10, 2017

(86) PCT No.: PCT/GB2017/052022
§ 371 (c)(1),
(2) Date: Mar. 20, 2019

(87) PCT Pub. No.: WO2018/055323
PCT Pub. Date: Mar. 29, 2018

(65) Prior Publication Data

US 2020/0018020 A1 Jan. 16, 2020

(30) Foreign Application Priority Data

Sep. 20, 2016 (GB) ..... 1616005.3

(51) Int. Cl.
*E01C 19/50* (2006.01)
*E04G 17/14* (2006.01)
*E04G 11/36* (2006.01)

(52) U.S. Cl.
CPC ..... *E01C 19/502* (2013.01); *E04G 11/36* (2013.01); *E04G 17/14* (2013.01)

(58) Field of Classification Search
CPC ..... E01C 19/50; E01C 19/502; E04G 17/14
(Continued)

(56) References Cited

U.S. PATENT DOCUMENTS 1,495,305 A * 5/1924 Heltzel ..... B02C 2/005 249/6
1,527,698 A * 2/1925 Pearthree ..... E01C 19/502 249/7

(Continued)

FOREIGN PATENT DOCUMENTS

CA 1329492 C 5/1994
CA 2957857 A1 3/2015

(Continued)

OTHER PUBLICATIONS

PCT Search Report & Written Opinion for Appl No. PCT/GB2017/052022 dated Oct. 5, 2017, 13 pages.

(Continued)

*Primary Examiner* — Michael Safavi
(74) *Attorney, Agent, or Firm* — Maine Cernota & Rardin

(57) ABSTRACT

Disclosed herein is a form work (1) for forming an edge of a poured slab roadway or pavement, the form work (1) comprising a metal edging member (2) having a roadway facing surface (3) and an opposite bracing surface (4), wherein the bracing surface (4) comprises a plurality of first brackets (5) for engaging with roadway pins (13), the first brackets (5) extending outwardly from the bracing surface (4) and configured to lock the pins (13) such that in use the form work (1) is held in position with respect to the pin (13).

18 Claims, 10 Drawing Sheets

(58) Field of Classification Search
USPC ..... 249/2, 3, 4, 5, 6, 7, 8, 194
See application file for complete search history.

(56) References Cited

U.S. PATENT DOCUMENTS 1,652,480 A * 12/1927 Hutchins ..... E04G 15/00 249/27
1,770,518 A * 7/1930 Harrold ..... E01C 19/506 249/5
1,939,007 A 12/1933 Heltzel
2,251,775 A * 8/1941 Arrighini ..... E04G 13/00 249/34
2,482,367 A 9/1949 Ravers, Jr.
2,626,444 A * 1/1953 Wolf ..... E01C 19/506 249/8
2,661,516 A * 12/1953 Yates ..... E01C 19/502 249/6
2,663,925 A * 12/1953 Yates ..... E01C 19/502 249/6
2,722,045 A * 11/1955 Yates ..... E01C 19/502 249/6
2,731,700 A * 1/1956 Yates ..... E01C 19/502 249/6
2,741,821 A 4/1956 Findley
2,843,911 A * 7/1958 Maine ..... E01C 19/502 249/6
2,846,748 A * 8/1958 Owen ..... E01C 19/502 249/7
2,917,803 A * 12/1959 Phillips ..... E01C 19/502 249/6
3,035,321 A 5/1962 Hennig
3,242,833 A * 3/1966 Sondheim ..... E01C 19/502 249/208
3,428,287 A 2/1969 Redding et al.
4,579,312 A * 4/1986 White ..... E01C 19/506 249/134
4,659,054 A 4/1987 Allen
4,690,367 A * 9/1987 Weathers ..... E01C 19/502 206/372
4,712,764 A * 12/1987 White ..... E01C 19/502 249/134
4,824,068 A * 4/1989 Ferland ..... E01C 19/506 249/157
4,921,204 A 5/1990 Melfi
4,996,770 A 3/1991 McCracken
5,076,536 A 12/1991 Fitzgerald
5,096,155 A 3/1992 Fitzgerald
5,261,635 A * 11/1993 Flathau ..... B28B 23/00 249/114.1
5,817,247 A * 10/1998 Colatruglio ..... E01C 19/502 249/4
6,367,764 B1 * 4/2002 Butler ..... E02D 27/00 249/18
6,536,737 B1 * 3/2003 Davis ..... E04G 13/00 249/210
6,918,567 B2 * 7/2005 Ward ..... E04G 13/00 249/189
7,303,361 B1 * 12/2007 Lane ..... E04G 9/05 249/1
7,832,705 B2 * 11/2010 Spencer ..... E04G 17/14 249/219.1
7,841,576 B2 * 11/2010 Miller ..... E01C 19/502 249/208
8,028,476 B1 10/2011 Alford
8,215,608 B2 * 7/2012 Oleson ..... E01C 19/502 249/6
8,919,726 B2 * 12/2014 Hendricks ..... E04G 11/062 249/192
9,328,469 B2 * 5/2016 Radu, Jr. ..... E01F 1/00
2002/0195536 A1 * 12/2002 Flathau ..... E04G 17/001 249/48
2003/0146365 A1 8/2003 Miller
2006/0201743 A1 9/2006 Dell'Erba et al.
2012/0155960 A1 * 6/2012 Lowery ..... E01C 19/502 404/72
2017/0292280 A1 10/2017 White
2017/0370099 A1 * 12/2017 Chevis ..... E04G 11/00
2018/0073259 A1 * 3/2018 Johnson ..... E04G 17/14
2018/0298625 A1 10/2018 White
2019/0194887 A1 6/2019 Kim

FOREIGN PATENT DOCUMENTS

CN 202064630 U 12/2011
DE 2142150 A1 3/1972
DE 4000400 A1 7/1991
DE 202006019268 U1 5/2007
EP 3169857 A1 5/2017
EP 3042009 A1 7/2019
FR 1557938 A 2/1969
FR 2527711 A1 12/1983
FR 2542789 A1 9/1984
FR 2835554 A1 8/2003
FR 2884536 A1 10/2006
GB 696260 A 8/1953
GB 762382 A 11/1956
GB 770446 A 3/1957
GB 787200 A * 12/1957 ..... E01C 19/502
GB 807681 A 1/1959
GB 2508263 A 5/2014
GB 2533172 A 6/2016
GB 2539371 A 12/2016
GB 2556866 A 6/2018
GB 2561567 A 10/2018
GB 6054088 2/2019
GR 1004120 B 1/2003
JP 01105867 A 4/1989
JP H01105867 A 4/1989
JP H07300856 A 11/1995
JP 01061181 A 3/1998
JP H1061181 A 3/1998
WO 9203626 A1 3/1992
WO 9214015 A1 8/1992
WO 9420694 A1 9/1994
WO 2007024883 A2 3/2007
WO 2013016760 A1 2/2013
WO 2015033109 A1 3/2015
WO 2016110663 A 7/2016
WO 2018055323 A1 3/2018

OTHER PUBLICATIONS

PCT/GB2019/050329—Has not yet published—Application as filed has been used for reference.
GB Search Report dated Jul. 7, 2015 of Patent Application No. GB1500178.7, 8 pages.
International Search Report and Written Opinion, dated Dec. 17, 2015 of Patent Application No. PCT/GB2015/053233 filed Oct. 28, 2015, 12 pages.
Notice of Allowance for Patent Appl. No. 14916041, dated Jul. 21, 2020, 12 Pages.

* cited by examiner

ROAD FORM WORK

RELATED APPLICATIONS

This application is a national phase application filed under 35 USC § 371 of PCT Application No. PCT/GB2017/052022 with an International filing date of Jul. 10, 2017, which claims priority of GB Patent Application 1616005.3 filed Sep. 20, 2016. Each of these applications is herein incorporated by reference in its entirety for all purposes.

FIELD OF THE INVENTION

The present invention relates for form work, particularly form work used for creating roadways or pavements.

BACKGROUND TO THE INVENTION

The conventional way of building a roadway or laying a slab of road surface, such as concrete, involves creating a bespoke wooden surround known as a form work. Being bespoke, once the roadway has been poured and the surface set, the wood is removed and discarded, as it is not transferable to other sites where the roadways have different dimensions. This is very wasteful and not very environmentally friendly. It is also very difficult to make curved surfaces out of wood without expending considerable time and energy, which ultimately increases the cost of any project.

Metal edging is sometimes used, especially where great thicknesses of roadway are used, and the pressure against the form work is considerable. However, such metal form work is expensive, bespoke, and requires considerable design and set up. In some cases the use of cranes is required, which limits the number of sites where it can be used. Also the metal parts are prone to bending and warping and corrosion.

There has now been devised a form work which overcomes and/or substantially mitigates the above referenced and/or other disadvantages associated with the prior art.

SUMMARY OF THE INVENTION

In an aspect of the invention there is provided a form work for forming an edge of a poured slab, roadway or pavement, the form work comprising a metal edging member having a roadway facing surface and an opposite bracing surface, wherein the bracing surface comprises a plurality of first brackets for engaging with roadway pins, the first brackets extending outwardly from the bracing surface and configured to lock the pins such that in use the form work is held in position with respect to the pin.

The form work according to the invention is advantageous primarily because it can be transported to site easily and provides a sturdy surface against which any road surface material can be poured, whether it be concrete or tarmac or the like. The form work according to the invention is also reusable, which means that after the road surface has been laid it can be taken up and used on a different project.

The first brackets can take on a number of forms. Suitable examples include but are not limited to 'L' shaped pieces of metal welded to the bracing surface, or simple extensions from the back of the bracing surface along one edge so that the metal edging member forms a 'L' shape in certain cross sections. In both cases the base of the 'L' could be configured to receive a roadway pin or the like. Preferably the first brackets comprise 'V' shaped wedge brackets secured by welds onto the bracing surface. This is a simple bracket form and increases the strength of the metal edging member because it is welded in two places and therefore forms a sort of bridging support at the back of the metal edging member. It has the benefit that the overall width of the metal edging support can be reduced, thereby reducing the overall weight of the form work, whilst surprisingly improving the overall strength. This greatly improves the strength of the formwork with only minimal extra materials. The central part of the 'V' provides an opening for receipt of the roadway pin in use.

The 'V' shaped wedge brackets comprise at least two openings, one on each side of the 'V' bracket, each opening being configured to receive a wedge there through such that in use the formwork is held in position with respect to the roadway pins by retention of the pin against the wedge and the bottom edge of the 'V' shaped wedge bracket. This provides a quick and efficient way to mount the form work at the side of the planned road or pavement, and to set out the dimensions of the road or pavement accurately. As long as the pin does not move, the roadway facing surface will not move either. The openings are opposite one another. In use a wedge is inserted through one opening on one side of the 'V' and engages with the opening on the opposite side of the 'V'. Preferably each 'V' shaped bracket has two sets of openings one on each side of the 'V' to receive two wedges. Each set consists of two openings. The set of openings on one side of the 'V' is opposite the set of openings on the opposite side of the 'V'. In use one wedge is inserted through one opening on one side of the 'V' and engages with the opening on the opposite side of the 'V'. And a second wedge is inserted from the opposite direction through the second opening from the opposite side of the 'V' and engages with the corresponding opening on the opposite side of the 'V'. When the wedges are inserted in this manner to hold the roadway pin against the bottom of the 'V' the formwork is held surprisingly sturdy and static. Twisting of the formwork is prevented and any loosening of the wedges unintentionally is prevented.

The metal edging member is preferably resiliently deformable. This has the benefit that it can be bent into many different shapes and will return to its natural shape after forces have been removed. So with regards roadways and pavements it means that curved and slanted edges can be created, but then when the form work is taken up for use on another project, it can return to a naturally flat structure, which makes packing, storage and transportation easy and efficient. It will be appreciated though that the metal edging member may be rigid and for forming straight edges this is preferred.

Preferably, the metal edging member comprises a plurality of second brackets. This has the benefit of providing extra ways of supporting the form work. A number of designs of second brackets are considered, but preferably the second brackets have a 'C' shaped construction and are secured by welds to opposite edges of the metal edging member and extending in the same direction as the first brackets. This provides the most cost efficient and strongest way of supporting the form work.

The second brackets may be configured to join with neighbouring second brackets, when two form works are placed edge on edge, to increase the height of the overall form work. However, preferably the second brackets are configured to engage with a supporting member. A supporting member can be any conventional device used to support form work. In the present invention using the form work bracket as described in GB2508263 is particularly suited. The bracket described in GB2508263 can be affixed to any surface and so it means that the form work can be mounted to any surface, which includes (but not limited to) concrete, plywood decking, hardcore, tarmac or the like.

The benefit of this arrangement is that in use a plurality of form works may be supported edge on edge by engaging the second brackets with supporting members. This enables the user to increase the height of the formwork, whilst maintaining the structural integrity and a continuous roadway contact surface. This is something not possible with conventional road former systems. This also prevents the natural tendency in conventional systems for the angle of the roadway facing surface with respect to the ground to change as the height of the form work increases and the weight of the roadway material in front of the formwork increases. The support members themselves may or may not be affixed to the ground in use. Drift of the form work is prevented by the engagement of the roadway pins with the first brackets.

It will be appreciated that to form a long length of form work the joining together of consecutive form works is necessary. Neighbouring form works may be joined by a plate which overlays part of the bracing surface of two neighbouring form works and spans the gap between them. Ideally the two formworks are abutted up against one another so no gap forms. The ends of the metal edging member may have a right angle construction or have bolted to them a length of right angle metal the same width as the metal edging member. This provides the opportunity to join the form work up to something such as another formwork, or a separate structure.

Preferably, each right angle comprises at least one hole configured to receive a fixing there through so that in use a plurality of form works abutted against one another may be joined together end to end by aligning holes on adjoining right angles, and fixing there through. Examples of suitable fixings include but are not limited to pins, bolt, or screws.

The metal edging member may have a channel shaped construction having a central section which comprises the roadway facing surface and the opposing bracing surface, and two surrounding flanges both extending at right angles from the central section and in the same direction as the first brackets. In use the central section would be directed towards the roadway material with the roadway facing surface forming a flat surface against which the roadway material may be abutted. In use one of the flanges would be in contact with the ground (or other form work—see later). The channel shaped construction has the benefit of making the form work rigid and therefore particularly suited to laying straight edges or having heavy road materials poured against it.

When the metal edging member has a channel shaped construction the first brackets preferably extend outwardly of the bracing surface by a distance which is greater than the width of either of the two flanges. This enables the roadway pin to be engaged through the first bracket without having to alter the flanges. This maintains strength. In this embodiment, the first brackets are not attached to the flanges in any way, and are only connected to the metal edging member by being welded to the bracing surface only. This reduces manufacturing costs whilst not affecting the strength.

The ends of the metal edging member may be closed. This provides a surface upon which to mount an adjoining form work, or to increase strength.

Preferably each of the closed ends comprises at least one hole configured to receive a fixing there through so that in use a plurality of form works abutted against one another may be joined together end to end by aligning holes on adjoining closed ends, and fixing there through. Suitable fixings are as described above. This enables the user to increase the length of the overall form work construction, in situ, without using cranes, and to any desired length.

Similarly any of the flanges may comprise holes configured to receive a fixing there through so that in use a plurality of form works abutted against one another may be joined together edge on edge by aligning holes on adjoining flanges, and fixing there through. This enables the user to increase the height of the overall form work construction, in situ, without using cranes, and to any desired height. Again, this is a benefit which distinguishes the invention from the prior art.

Another way of increasing the height of the overall formwork is further provided that in use a plurality of form works are supported edge on edge by engaging the second brackets with supporting members. The roadway facing surface is then built up as a substantially continuous surface. The ability to increase height of the formwork in this manner provides the user with an adaptable and safe alternative to the prior art.

The closed end may have bolted to it a length of right angle metal the same width as the metal edging member, and wherein in use, two form works may be connected at right angles to one another by fixing the right angle metal to opposing ends of neighbouring form works.

Neighbouring form works may be joined end to end by flexible infill panels. Suitable infill panels include but are not limited to plywood, flexible composite board, MDF etc. The benefit of the infill panels is that it means the user does not have to fly past the pour of the roadway material. The infill panel effectively bridges the gap between two form works. So for example, as most conventional road formers are built to 3 metre lengths only, if a builder needed to make a roadway of say 6.5 m along one edge, he would have to install 9 m of former, therefore having 2.5 m excess to requirements. With an infill panel the builder can build the overall length of the form work to exactly the desired length.

In use a shuttering contact board may attached to the roadway facing surface. This allows the user to increase the height or length of the form work without adjoining a separate form work. Then is also then allows the form which is of metal construction to have a smooth face attached to achieve a much higher grade of finish to the roadway surface. No conventional systems in the prior art provide this.

BRIEF DESCRIPTION OF THE DRAWINGS

The invention will now be described by way of example and/or illustration only with reference to the accompanying drawings in which.

DETAILED DESCRIPTION OF THE ILLUSTRATED EMBODIMENT

Figure 1:
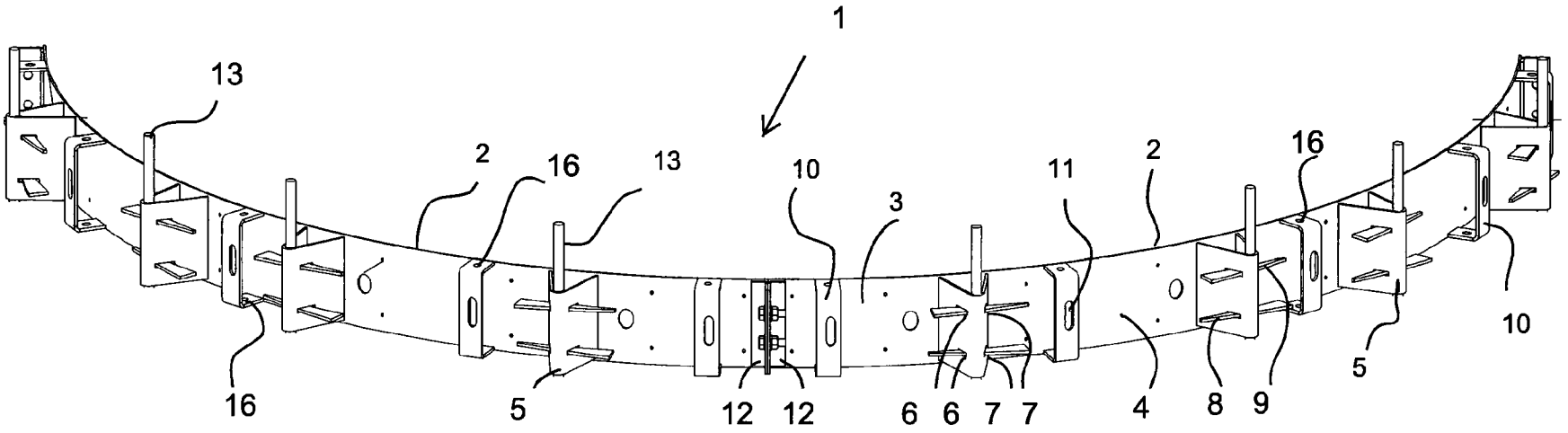
FIG. 1 shows an embodiment of the form work according to the invention pinned to the ground.

In FIG. 1 there is shown an example of the form work according to the invention. The form work is generally designated 1. In the example shown there are two form works joined together. Both formworks are identical. Each form work 1 comprises an edging member 2, which is a flat galvanised steel bar, 2.44 m long and 150 mm high. Bars of 200 mm heights are also possible. The bar may also be stainless steel. Options without galvanising are considered but not preferred as they do not confer the same corrosion proofing. The bar is 3 mm thick. The edging member 2 has a road way facing surface 3 and a bracing surface 4. Both sides of the member 2 are flat and smooth. The roadway facing surface is particularly smooths and continuous to give a matching finished to the roadway. Each formwork has welded to the bracing surface four first brackets 5. The first brackets 5 are positioned equally spaced apart as shown. The first brackets 5 are steel 'V' section brackets and extend outwardly of the bracing surface to the rear of the form work. The application of the 'V' section brackets surprisingly means that the formwork can be made from 3 mm steel whilst improving the strength of the metal edging member significantly. It is thought that this is due to the configuration of the welding of the brackets to the bracing surface and also the number of brackets per length of form work. In any case it means that the overall weight is reduced, which makes each road form easy to handle and more cost efficient.

Each 'V' shaped bracket has at least two openings one on each side of the 'V'. The openings are opposite one another. In the example shown in FIG. 1 there are two sets of openings 6, 7 one on each side of the 'V' to receive two wedges 8, 9. Each set consists of two openings. The set of openings on one side of the 'V' is opposite the set of openings on the opposite side of the 'V'. So in total there are four openings on the bracket.

As well as the first brackets 5 each form work comprises a set of second brackets 10. Each form work has five second brackets, interspersed between the first brackets 5. The second brackets 10 are comprised of steel 'C' sections which are welded to the top and bottom edges of the metal edging member 2. The second brackets 10 extend outwards in the same direction as the first brackets and each have an opening 11 to receiving a fixing for a support member (not shown in FIG. 1, see later).

The two form works 1 shown in FIG. 1 are joined at their ends by right angle members which are each welded to the ends of the formwork and then bolted to each other on the bracing side of the edging member. This means that the roadway facing surface 3 is kept continuous and smooth and substantially flat.

An the formwork in this embodiment is a flat steel bar, it can be bent as shown in the FIG. 1, so that curved edges can be formed in the roadway.

In use the formworks are joined together and manipulated into position as required to where the edge of the desired roadway should be. Road way pins 13 are then hammered through the 'V' shaped brackets generally parallel to the bracing surface. Wedges 8 and 9 are then inserted though the openings 6 and 7 from opposite directions. The pins 13 are thereby braced against the bottom part of the 'V' of each first bracket and against the wedges. In so doing the formwork is held secure such that sideways movement and twisting movement is prevented. The example shown in FIG. 1 shows the form work being position on ground, but it may otherwise be positioned on concrete or the like, and the pins may not necessarily be road pins. They could be fixing bolts or screws etc.

Figure 2:
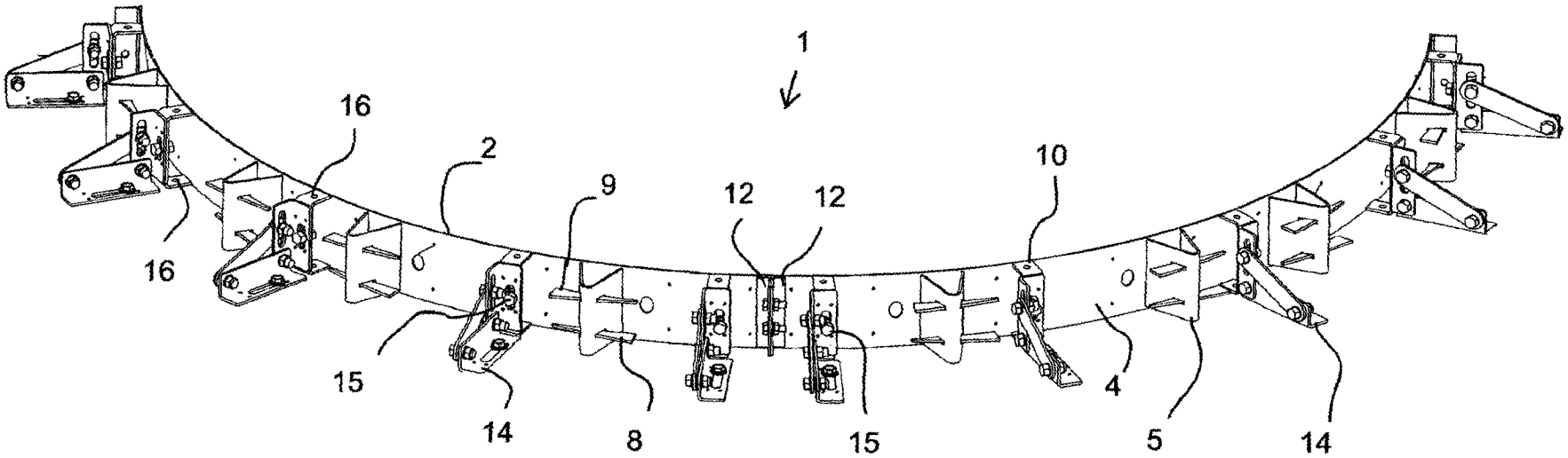
FIG. 2 shows an embodiment of the form work according to the invention secured using supporting members.

In FIG. 2 there is shown a form work set up which comprises all of the features of the form work 1 described above (pins 13 not shown). For extra stability and adjustment, support members 14 are used to hold the form work 1 in place as well as the pins. Each support member 14 comprises an adjustable triangular bracket of the type described in GB2508263B. Each support member 14 is fixed to the ground and the bolted to the second brackets 10 using a bolt 15. The angle of the roadway facing surface can be set by adjusting the members 14, as described in GB2508263B.

In use one wedge is inserted through one opening on one side of the 'V' and engages with the opening on the opposite side of the 'V'. And a second wedge is inserted from the opposite direction through the second opening from the opposite side of the 'V' and engages with the corresponding opening on the opposite side of the 'V'. When the wedges are inserted in this manner to hold the roadway pin against the bottom of the 'V' the formwork is held surprisingly sturdy and static. Twisting of the formwork is prevented and any loosening of the wedges unintentionally is prevented.

Figure 3:
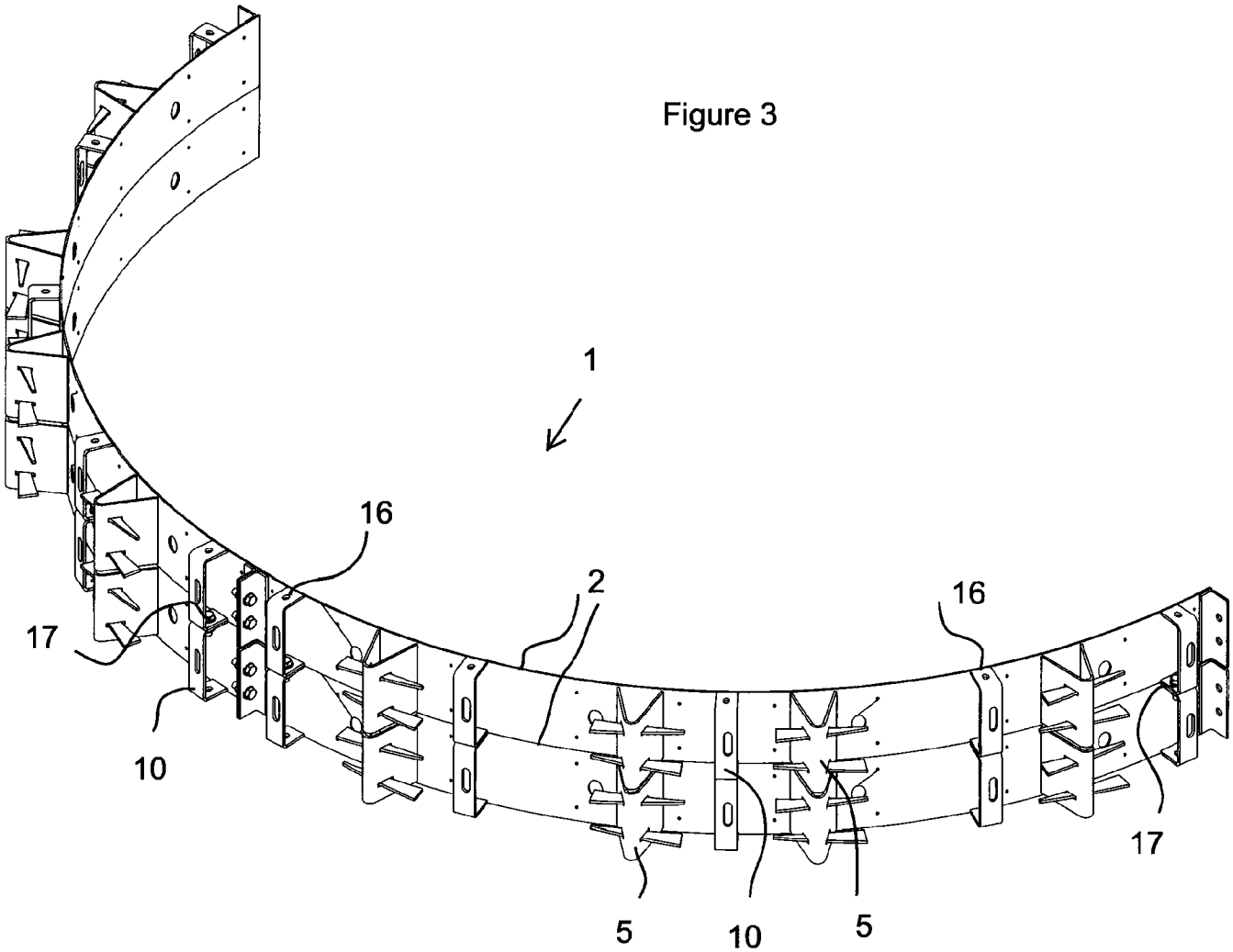
FIG. 3 shows an embodiment of the form work according to the invention in a stacked configuration.

FIG. 3 shows the form work 1 in a stacked configuration. If for example the user needs to build a road way which is thicker than the width of one formwork on its own then the form work of the invention can be joined together to form a stacked arrangement as shown. In the figure there are four separate identical form works of the type described in relation to FIG. 1. Initially two formworks 1 are laid down end to end and joined as described in relation to FIG. 1. Then a separate set of two form works joined in the same manner are superimposed on top of the first set as shown in the figure (FIG. 3). In so doing the openings 16 as shown in FIGS. 1 and 2 in the top and bottom parts of the 'C' section second brackets 10, align. A bolt 17 is then affixed through the openings as shown and a double height curved road way edging is created.

The benefit of this arrangement is that a curved roadway edging of any height can be constructed. The form work can be constructed as described above, and then the roadway material added against the roadway surface 3 of the form work. This material may be concrete or tarmac or hard core or the like. Once the roadway has been constructed or the material set, the form work 1 can be disassembled and used on another project. The benefit of all this is that no cranes are required, and with easily manageable sections, great lengths and heights can be created. Furthermore, as the metal bar of the metal edging member 2 is resiliently deformable, once the form work is taken up it springs back to its naturally straight orientation. This makes it easy to carry, pack and transport.

Figure 4:
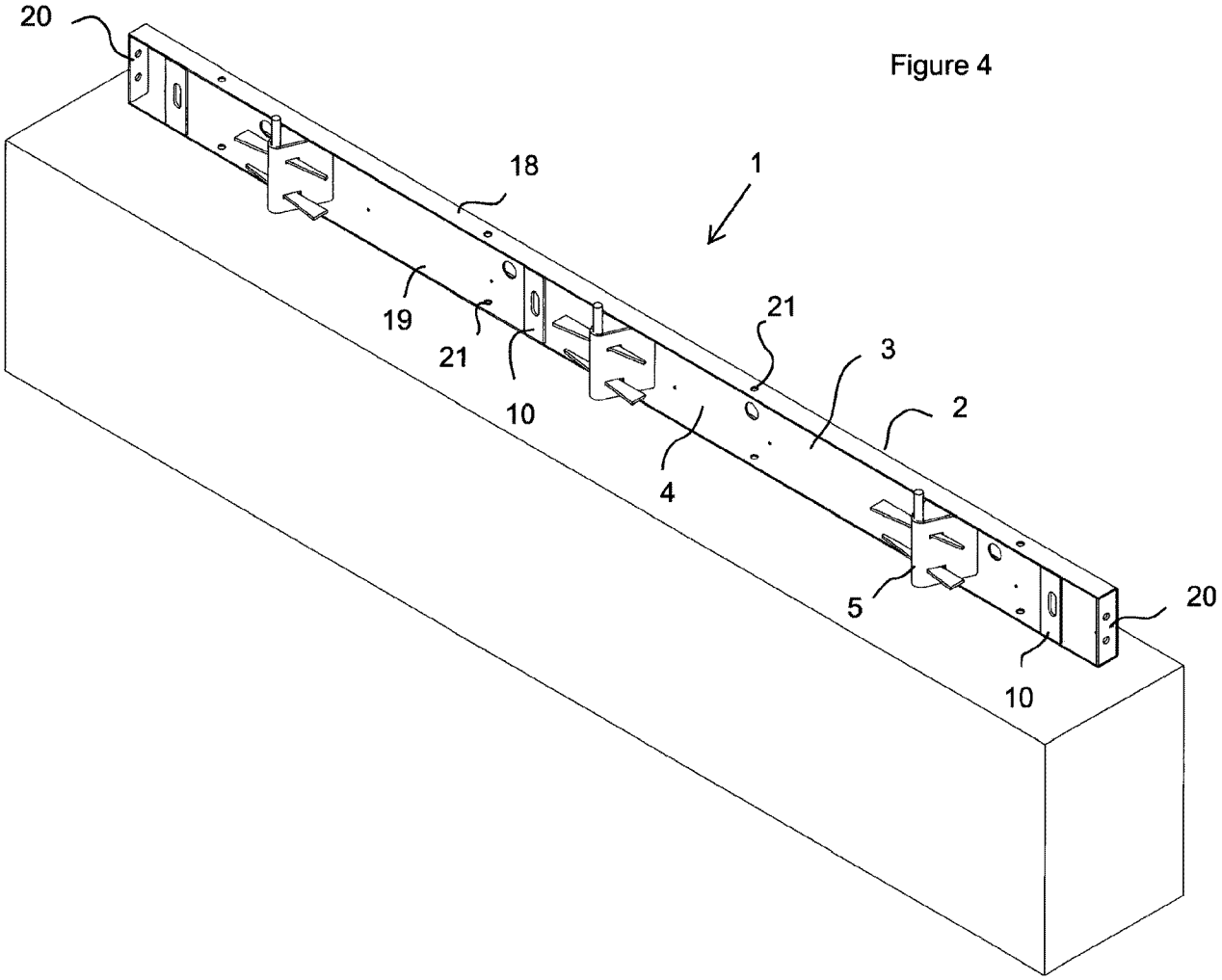
FIG. 4 shows an embodiment of the form work according to the invention, in particular showing the rigid embodiment secured to the ground using roadway pins.

FIG. 4 shows the rigid form of the formwork 1. The metal edging member 2 is formed into a galvanised metal bar having a channel cross section. Top and bottom flanges 18, 19 surround the central portion which makes up the bracing surface 4 and the opposite roadway facing surface 3. In the example shown the ends 20 are closed with a small piece of metal welded across the end. The ends have openings to that neighbouring formworks may be joined together end to end. The formwork is otherwise as described above in relation to FIG. 1, however the second brackets 10 are not 'C' section pieces of metal that the span the edge of the flanges 18 and 19. The second brackets 10 in this embodiment are welded to the edges of the flanges. AS there are no C section brackets there are no holes 16 as in the previous figures. These are replaced by holes 21 in the top and bottom flanges 18 and 19. FIG. 4 shows the form work 1 pinned to the ground using road way pins 13, as described above.

Figure 5:
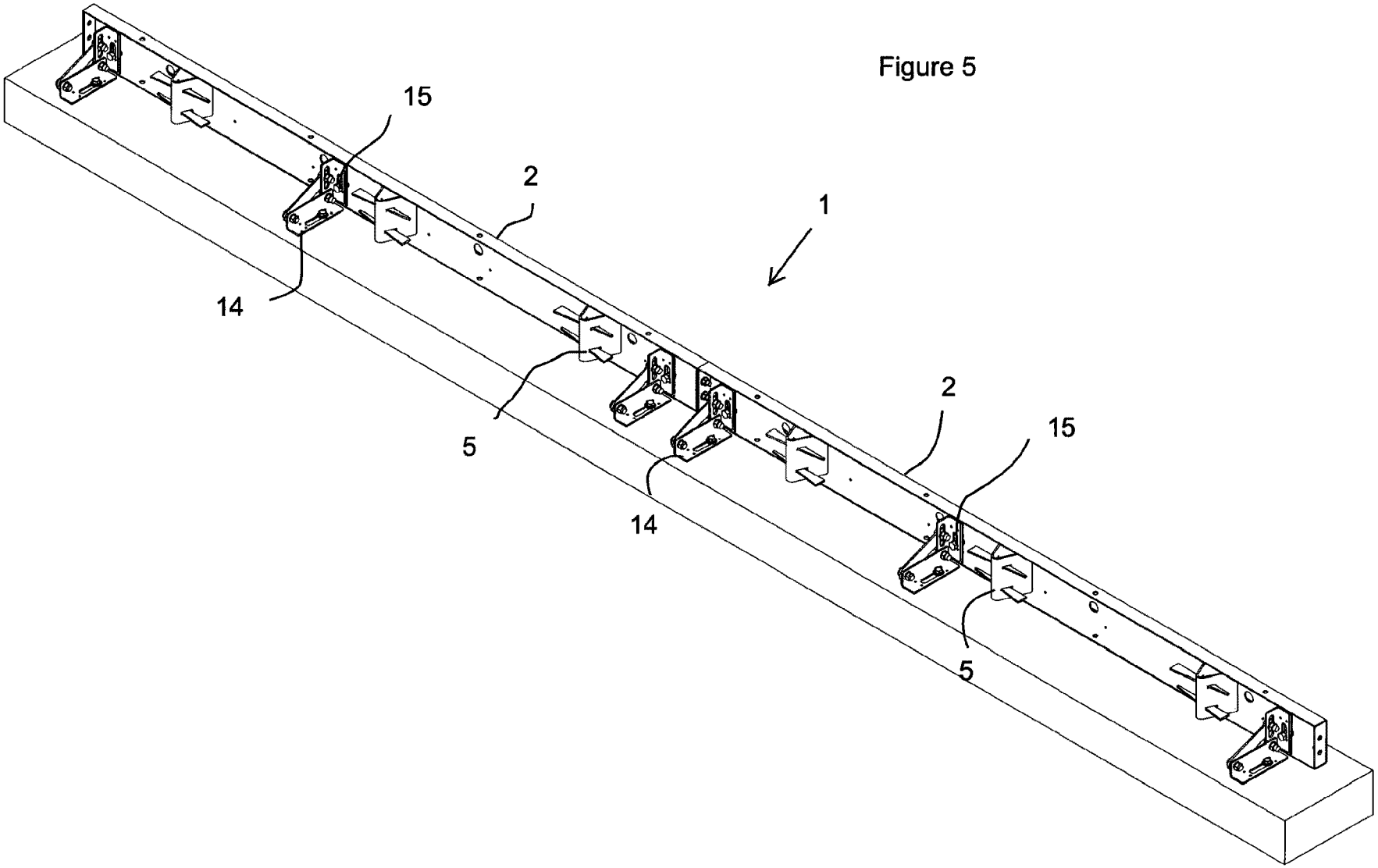
FIG. 5 shows an embodiment of the form work according to the invention, in particular showing the jointing of two rigid form works and securing to concrete using supporting members.

FIG. 5 shows two form works 1 as described in FIG. 4 joined together as described above, and support by supporting members 14 also as described above. This provides an extra way to support the formwork as well as the road pins 13 (not shown), and also allows for some adjustability of the formwork. The support member 14 fix to the ground and to the second brackets 10 as shown in the drawings.

The rigid form of the formwork 1, is set into position in substantially the same way as the flexible form as described above.

Figure 6:
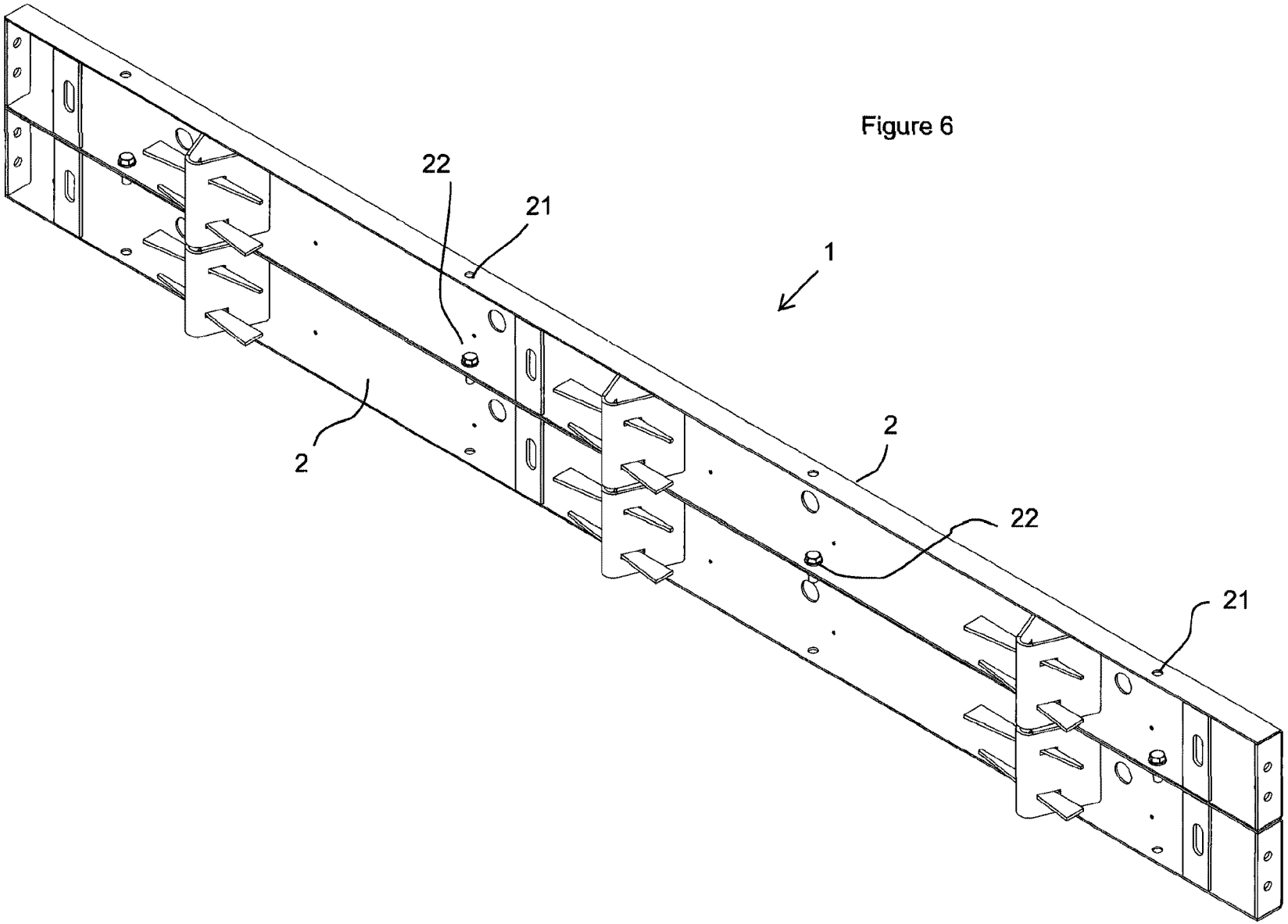
FIG. 6 shows an embodiment of the rigid form work of the invention in stacked configuration.

Therefore in a similar way to the flexible form, the rigid form may take on a stacked arrangement, as shown in FIG. 6 which shows two formworks superimposed on top of one another so that the top flange 18 of one formwork is abutting the bottom flange 19 of another formwork. In so doing the holes 21 will align and a fixing 22 can be used to fix the two formworks together. This enables the user to build upwards for increased thicknesses of roadway. If required support members (not shown) can be applied to engage with the second brackets of each formwork in the stacked arrangement to provide further support and adjustment.

Figure 7:
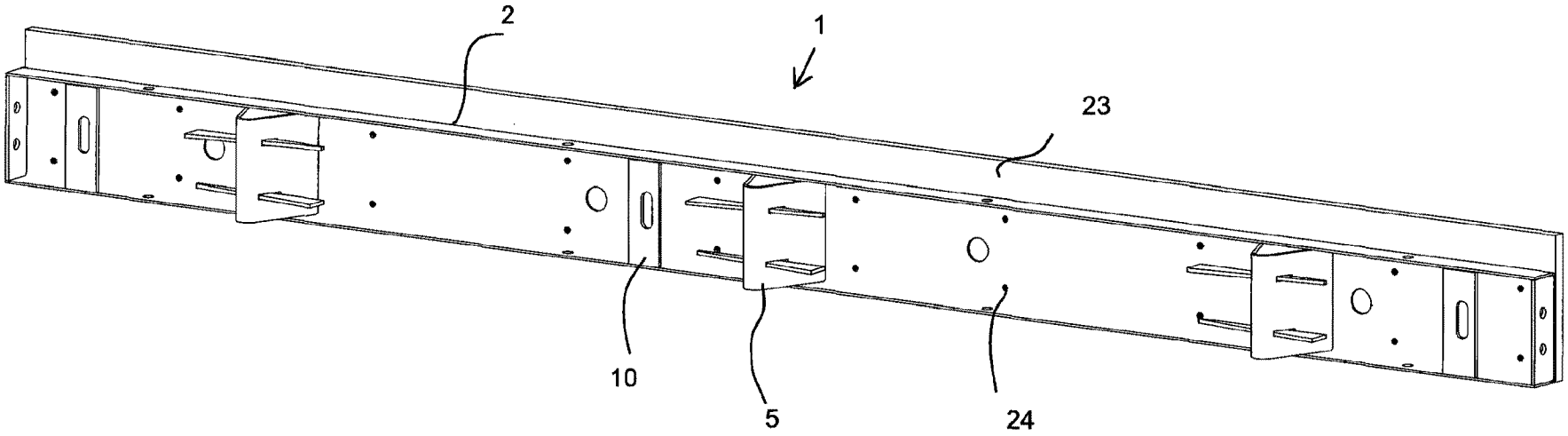
FIG. 7 shows an embodiment of the rigid form work of the invention with a plywood facia attached.

For all the above embodiments it is further possible to apply plywood or other shuttering contact board to the roadway facing surface (see FIG. 7). This gives a clean surface to the edge of the roadway once the material has been poured and set. The plywood 23 can be fixed with screw 24 onto the metal edging member, with the screws being inserted from the bracing surface or from the plywood side.

Figure 8:
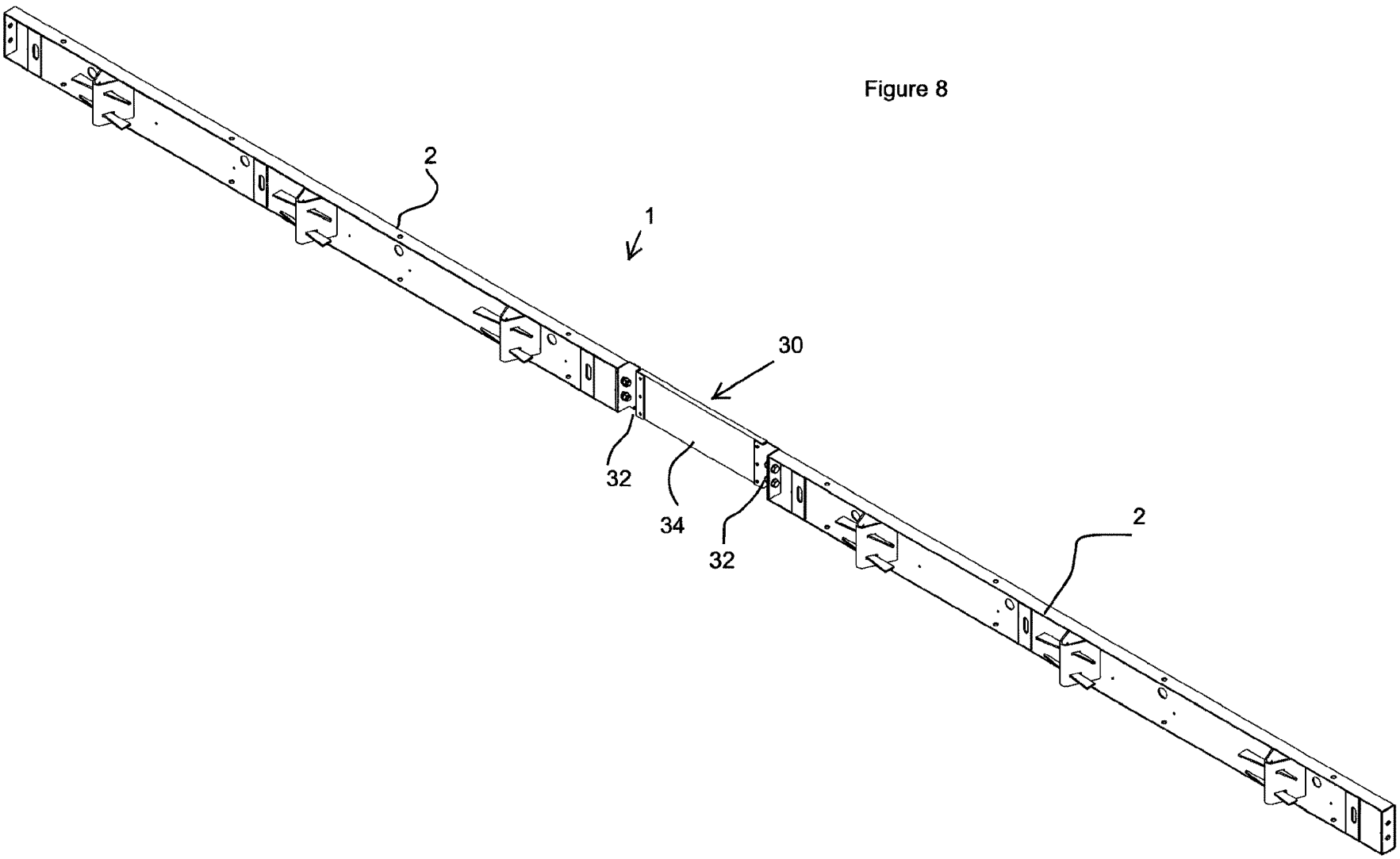
FIG. 8 shows an embodiment of the rigid form work according to the invention joined by an infill panel.
Figure 9:
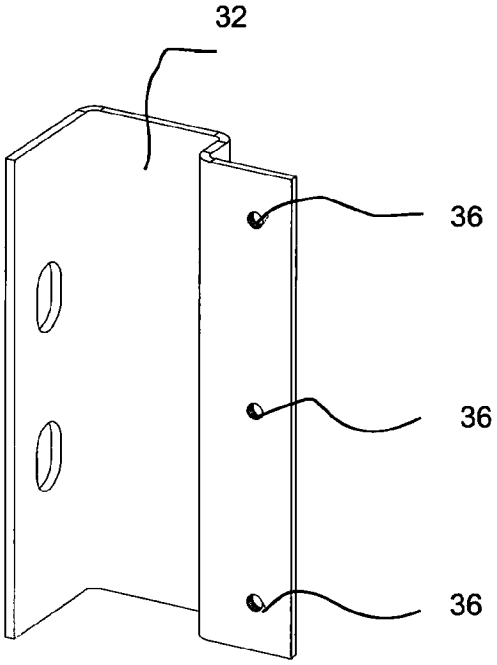
FIG. 9 shows an embodiment of the infill panel bracket according to the invention.

For all the above embodiments it is also possible to install an infill panel 30 between two adjoining form works. The infill panel can be sized accordingly so that the overall length of the two form works and panel is made to the required length. FIG. 8 shows how the infill panel is arranged. The closed end 20 of each form work 1 has an infill bracket 32 fixed to it by conventional nut and bolt fixing. The brackets 32 have an extension which allows for mounting of a section of plywood 34, which can be cut to size during use. The plywood spans the gap between the two brackets and is fixed thereto using screws through holes 36. The road way facing surface is thereby continuous over both the formworks and the infill panel. Closer detail of the left hand bracket from FIG. 8 is shown in FIG. 9. The right hand bracket is the mirror of it.

Figure 10:
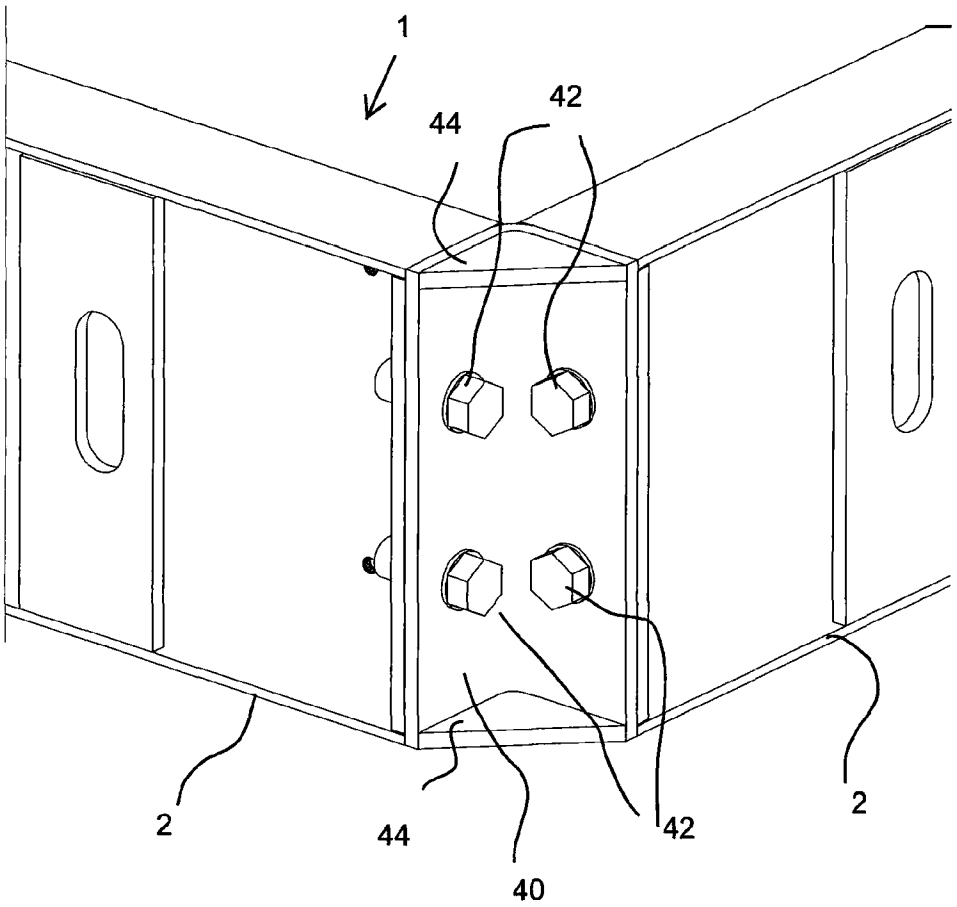
FIG. 10 shows an embodiment of the right angle corner brackets according to the invention.

For all the above embodiments it is also possible to install a right angle section 40, as shown in FIG. 10. The right angle section 40 is a piece of right angle steel with two bracing supports 44 for strength. The section is connected between two adjoining form works 1 at the closed end 20 or at the angle brackets 12. By connection using the bolts 42 as shown, the roadway facing surfaces of the two formworks are made to extend at right angles to one another. This is particularly useful when square edge corners are required. This is also useful when solid slabs are required to be poured surrounded by form works 1, as the brackets prevent the sides from bulging out. In alternative embodiment the right angle sections 40 can be made flexible, from flexible rubber, when curved or angular joins are required.

The inventors have surprisingly found a number of advantages associated with the form work according to the invention and as described above. These are as follows.

The combination of 3 mm thick steel and the angular V shaped brackets means that the overall weight of each form work is reduced but strength is increased from conventional systems.

Being optionally galvanised or of stainless steel the form work will last longer than any other conventional system.

The formwork can be made into straight or curved forms and available in heights from 150 mm up to 1800 mm high.

The form work in the example is built in 2.44 m lengths which is the same as standard ply sheets, in the case of fair face work. It also makes them safe to man handle.

The unique infill system copes with anything length so you don't have to fly past your pour.

There are optional 90 degree corner jointing sections to make solid corners that won't move. Which is ideal for slab pours.

The form work can be fitted with road pins, but can also have support members for extra stability and adjustment.

The form work can be used for slab edge work on decking as the support members can be held down with decking screws.

The invention claimed is:

1. A form work for forming an edge of a poured slab, roadway or pavement, the form work comprising a metal edging member having a roadway facing surface and an opposite bracing surface, wherein the bracing surface comprises a plurality of first brackets for engaging with roadway pins, the first brackets extending outwardly from the bracing surface and configured to lock the pins such that in use the form work is held in position with respect to the pin; the metal edging member having a plurality of second brackets, wherein the second brackets have a 'C' shaped construction and are secured by welds to opposite edges of the metal edging member and extending in the same direction as the first brackets.

2. The form work according to claim 1, wherein the first brackets comprise 'V' shaped wedge brackets secured by welds onto the bracing surface.

3. The form work according to claim 2, wherein the 'V' shaped wedge brackets comprise at least two openings, one on each side of the 'V' bracket, each opening being configured to receive a wedge there through such that in use the formwork is held in position with respect to the roadway pins by retention of the pin against the wedge and the bottom edge of the 'V' shaped wedge bracket.

4. The form work according to claim 1, wherein the metal edging member is resiliently deformable.

5. The form work according to claim 1, wherein the metal edging member is approximately 3-10 mm thick.

6. The form work according to claim 1, wherein the second brackets are configured to engage with a supporting member.

7. The form work according to claim 6, wherein in use a plurality of form works are supported edge on edge by engaging the second brackets with supporting members.

8. The form work according to claim 1, wherein the ends of the metal edging member has a right angle construction or has bolted to it a length of right angle metal the same width as the metal edging member.

9. The form work according to claim 8, wherein each right angle comprises at least one hole configured to receive a fixing there through so that in use a plurality of form works abutted against one another may be joined together end to end by aligning holes on adjoining right angles, and fixing there through.

10. The form work according to claim 1, wherein the metal edging member has a channel shaped construction having a central section which comprises the roadway facing surface and the opposing bracing surface, and two surrounding flanges both extending at right angles from the central section and in the same direction as the first brackets.

11. The form work according to claim 10, wherein the first brackets extend outwardly of the bracing surface by a distance which is greater than the width of either of the two flanges.

12. The form work according to claim 10, wherein the ends of the metal edging member are closed.

13. The form work according to claim 12, wherein each of the closed ends comprises at least one hole configured to receive a fixing there through so that in use a plurality of form works abutted against one another may be joined together end to end by aligning holes on adjoining closed ends, and fixing there through.

14. The form work according to claim 10, wherein any of the flanges comprises holes configured to receive a fixing there through so that in use a plurality of form works abutted against one another may be joined together edge on edge by aligning holes on adjoining flanges, and fixing there through.

15. The form work according to claim 1, wherein in use a plurality of form works are supported edge on edge by engaging the second brackets with supporting members.

16. The form work according to claim 1, wherein a closed end of said metal edging member has bolted to it a length of right angle metal the same width as the metal edging member, and wherein in use, two form works may be connected at right angles to one another by fixing the right angle metal to opposing ends of neighbouring form works.

17. The form work according to claim 1, wherein neighbouring form works are joined end to end by flexible infill panels.

18. The form work according to claim 1, wherein in use a shuttering contact board is attached to the roadway facing surface.

* * * * *